US009348292B2

(12) United States Patent
Chikugo

(10) Patent No.: US 9,348,292 B2
(45) Date of Patent: May 24, 2016

(54) FIXING APPARATUS HAVING FIXING DEVICE WITH FIRST AND SECOND FIXING MEMBERS, FEEDING DEVICE WITH FIRST AND SECOND FEEDING ROLLERS, AND FIRST AND SECOND ELECTRICAL DISCHARGING MEMBERS

(71) Applicant: CANON KABUSHIKI KAISHA, Tokyo (JP)

(72) Inventor: Youichi Chikugo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/669,634

(22) Filed: Mar. 26, 2015

(65) Prior Publication Data

US 2015/0277312 A1 Oct. 1, 2015

(30) Foreign Application Priority Data

Mar. 27, 2014 (JP) ..... 2014-066156

(51) Int. Cl.
*G03G 15/20* (2006.01)
*G03G 15/00* (2006.01)

(52) U.S. Cl.
CPC .. *G03G 15/6573* (2013.01); *G03G 2215/00421* (2013.01); *G03G 2215/00654* (2013.01); *G03G 2215/00658* (2013.01)

(58) Field of Classification Search
CPC ..... G03G 15/2053
USPC ..... 399/329, 67
See application file for complete search history.

(56) References Cited

U.S. PATENT DOCUMENTS

| | | | | |
|---|---|---|---|---|
| 7,890,024 | B2 | 2/2011 | Hirayama et al. | |
| 7,890,038 | B2 | 2/2011 | Chikugo et al. | |
| 9,026,020 | B2 | 5/2015 | Chikugo et al. | |
| 2004/0091279 | A1 * | 5/2004 | Izawa ..... | G03G 15/2028 399/67 |
| 2014/0161479 | A1 | 6/2014 | Yoshida et al. | |

FOREIGN PATENT DOCUMENTS

| | | | |
|---|---|---|---|
| JP | 04-019687 | H | 1/1992 |
| JP | 2011-232439 | A | 11/2011 |

* cited by examiner

*Primary Examiner* — Quana M Grainger
(74) *Attorney, Agent, or Firm* — Fitzpatrick, Cella, Harper & Scinto

(57) ABSTRACT

A fixing device includes a fixing device for nipping and feeding a sheet to fix a toner image on a sheet, said fixing device including a first fixing member contactable with a front surface of the sheet, and a second fixing member provided with an electroconductive surface layer contactable with a back surface of the sheet; a feeder provided downstream of said fixing device with respect to a sheet feeding direction to nip and feed the sheet, a feeder including a first feeding roller contactable with the front surface, and a second feeding roller provided with an electroconductive surface layer contactable with the back surface; a first discharging member contacted with said electroconductive surface layer of said second fixing member to discharge said second fixing member; and a second discharging member contacted with said electroconductive surface layer of said second feeding roller to discharge said second feeding roller.

13 Claims, 7 Drawing Sheets

FIXING APPARATUS HAVING FIXING DEVICE WITH FIRST AND SECOND FIXING MEMBERS, FEEDING DEVICE WITH FIRST AND SECOND FEEDING ROLLERS, AND FIRST AND SECOND ELECTRICAL DISCHARGING MEMBERS

FIELD OF THE INVENTION AND RELATED ART

The present invention relates to an image fixing device for fixing the toner image on a sheet of recording medium. A fixing device can be used in an image forming apparatus such as a copying machine, a printer, a facsimile machine, and a multifunction apparatus having a plurality of the functions of the preceding examples of image forming apparatus.

An image forming apparatus, such as an electrophotographic image forming apparatus and electrostatic recording apparatus, electrostatically forms an unfixed toner image on a sheet of recording medium, and fixes the unfixed toner image to the sheet by applying heat and pressure to the toner image with the use of the fixing member of its fixing device.

In the field of image forming apparatuses such the above-described ones, there have been well known the problems attributable to the application of high voltage which occurs during the transfer of the toner image, and the problem that a sheet of recording medium becomes electrically charged due to the friction between the sheet and the fixing member.

As a sheet of recording medium becomes charged, it is electrostatically adhered to a sheet conveyance guide which makes up a part of the recording medium conveyance passage of an image forming apparatus. Therefore, it sometimes occurs that the sheet is unsatisfactorily conveyed. Further, as the sheet becomes charged, there occurs sometimes a phenomenon (which hereafter is referred to as "electrostatic offset") that the unfixed toner image on the sheet is electrostatically adhered to the surface of the fixing member. As the toner is electrostatically adhered to the fixing member, it is transferred from the fixing member onto the portions of the sheet, reducing thereby the image on the sheet in quality.

There is disclosed in Japanese Laid-open Patent Application 2011-232439, a structural arrangement for making electrically conductive, the pair of conveyance rollers, which are on the downstream side of the fixation nip, in terms of the recording medium conveyance direction, in order to prevent the sheet of recording medium and fixing member from becoming charged. Further, there is disclosed in Japanese Laid-open Patent Application H04-019687, a method which employs an electrically conductive member as a component for forming the fixation nip in order to obtain an effect similar to the above-described one.

On the other hand, it is necessary to separate a sheet of recording medium, to which melted toner has adhered, from the fixing member for forming a fixing nip, and the conveyance roller pair through which a sheet of recording medium is conveyed after being conveyed through the fixation nip. Thus, a roller having a release layer is widely used as the fixing member or conveyance roller. Generally speaking, therefore, the release layer is made of a piece of tube made of fluorine resin or the like substance, which is excellent in releasing properties, or is coated as the surface layer on the fixing member.

In the case of a fixing device structured as described above, it is effective to make electrically conductive, the surface layer which comes into contact with a sheet of recording medium. One of the widely known methods for making the surface layer electrically conducive is to mix an electrically conductive substance (carbon or the like) into the material for the release layer in order to reduce the material in volume resistivity.

In recent years, demand has been increasing for image forming apparatuses which are higher in operational speed, and also, are capable of dealing with various types of recording medium. Thus, image forming apparatuses have been increasing in the amount by which recording medium is charged. For example, in order to increase an image forming apparatus in operational speed, or enable the apparatus to deal with a thick sheet of recording medium, an image forming apparatus has to be increased in the efficiency with which it can transfer a toner image onto a sheet of recording medium. In order to increase an image forming apparatus in the toner image transfer efficiency, the apparatus has to be increased in transfer voltage, which results in the amount by which recording medium is charged. Further, as an image forming apparatus is increased in recording medium conveyance speed, the apparatus increases in the friction which occurs between the fixing member and the sheet, and/or between the sheet and conveyance guide. Therefore, recording medium is likely to be given a greater amount of electrical charge.

A toner image electrostatically formed on recording material is in an electrically unstable state. Therefore, an image forming apparatus can be effectively improved in terms of the image anomalies which occur in a fixing device, and recording conveyance errors which occur in the recording medium conveyance passage, which is on the downstream side of the fixing device, by enabling the image forming apparatus to effectively discharge the recording medium immediately after the recording medium comes out of the fixation nip, in which a toner image is fixed.

For the purpose of improving an image forming apparatus in the efficiency with which it can discharge recording medium in the adjacencies of the fixing device, it is effective to reduce in volume resistivity, the surface layer of the above described fixing member which forms the fixation nip, and the surface layer of the conveyance roller pair which recording medium passes immediately after it is conveyed through the fixation nip.

However, if the fixing member is simply reduced in volume resistivity to increase the fixing member in charge removal efficiency, it sometimes occurs that as voltage is applied to transfer a toner image onto recording medium, electric current flows to the fixing member. Thus, it sometimes becomes impossible to apply a sufficient amount of transfer voltage to recording medium in the transfer section. Therefore, it sometimes occurs that a toner image fails to be satisfactorily transferred onto recording medium.

Further, in a case where a piece of tube is used as the release layer, the amount by which electrically conductive substance is mixed into the tube material has to be increased to reduce the tube in volume resistivity. Increasing the tube material in the content of electrically conductive substance possibly results in the formation of a tube which is less durable. Thus, the surface layer will be less resistant to friction, or it sometimes occurs that the surface layer tears.

Furthermore, there is an issue that mixing an electrically conductive substance into the material for the surface layer reduces the surface layer in releasing properties. If the surface layer of the members which come into contact with the toner image bearing surface of recording medium is insufficient in release performance, it sometimes occurs that while toner is becoming fixed to recording medium after being melted, it accumulates on the surface of the members, and then, redeposits itself on recording medium, which results in the occurrence of image anomalies.

Thus, the primary object of the present invention is to satisfactorily remove electrical charge from recording medium in the adjacencies of the fixation nip, without causing image anomalies and the like.

SUMMARY OF THE INVENTION

According to an aspect of the present invention, there is provided a fixing device comprising a fixing device configured to nip and feed a sheet to fix a toner image on a sheet, said fixing device including a first fixing member contactable with a toner image carrying surface of the sheet, and a second fixing member provided with an electroconductive surface layer contactable with a surface of the sheet opposite the toner image carrying surface; a feeding device provided downstream of said fixing device with respect to a feeding direction of the sheet and configured to nip and feed the sheet, feeding device including a first feeding roller contactable with the toner image carrying surface of the sheet, and a second feeding roller provided with an electroconductive surface layer contactable with the surface of the sheet opposite the toner image carrying surface; a first electrical discharging member contacted with said electroconductive surface layer of said second fixing member to electrically discharge said second fixing member; and a second electrical discharging member contacted with said electroconductive surface layer of said second feeding roller to electrically discharge said second feeding roller.

Further features of the present invention will become apparent from the following description of exemplary embodiments (with reference to the attached drawings).

DESCRIPTION OF THE EMBODIMENTS

Embodiment 1

Hereinafter, preferred embodiments of the present invention are described in detail with reference to appended drawings.

<Image Forming Apparatus>

Figure 2:
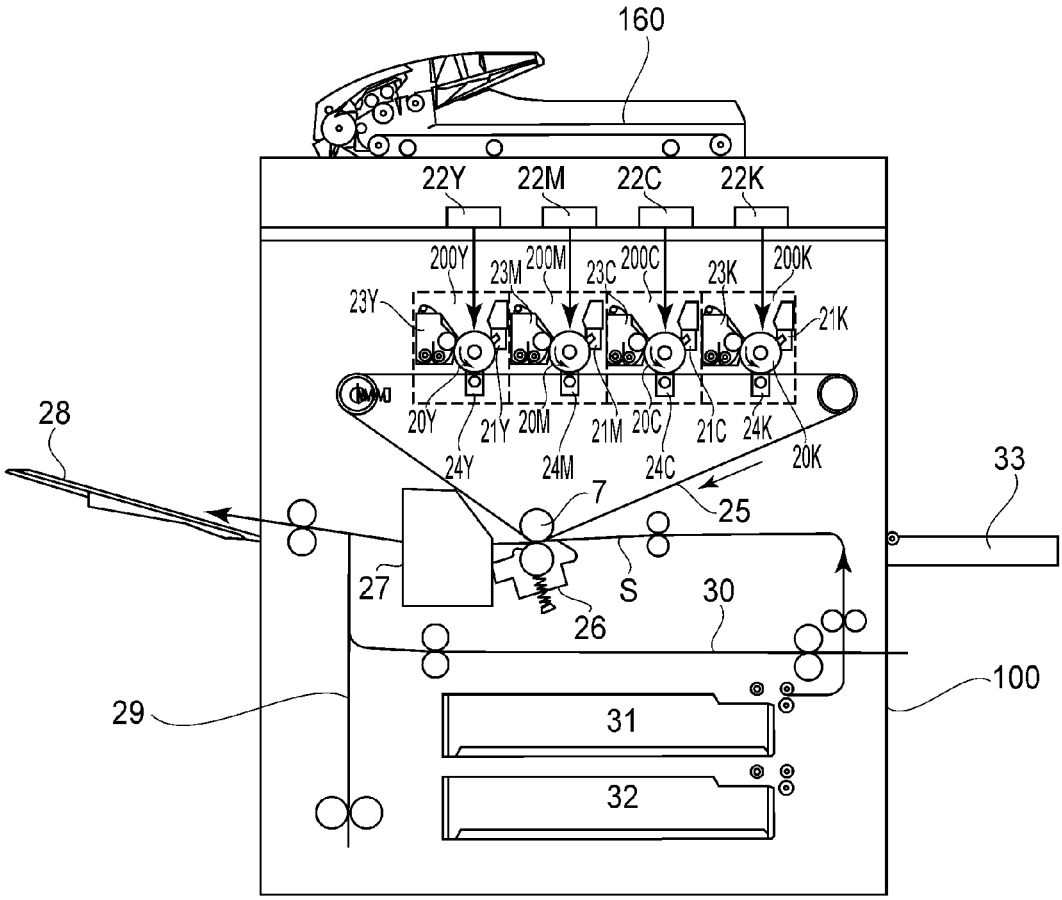
FIG. 2 is a schematic sectional view of the image forming apparatus in the first embodiment of the present invention.

FIG. 2 is a schematic drawing of an example of image forming apparatus such as a copying machine, a printer, a facsimile machine and a multifunction machine. An image forming apparatus 100 is equipped with a fixing device 27 which fixes an unfixed toner image transferred onto a sheet S of recording medium, to the sheet by applying heat and pressure to the unfixed toner image. The image forming apparatus 100 in this embodiment is a full-color image forming apparatus of the so-called intermediary transfer type. However, this embodiment is not intended to limit the present invention in scope.

The image forming apparatus 100 is equipped with four image bearing members (electrophotographic photosensitive members) 20Y, 20M, 20C and 20K, which bear an electrostatic latent image on their peripheral surface, corresponding to four colors, for example, Y (Yellow), M (magenta), C (cyan) and K (black), respectively. Hereinafter, in order to avoid descriptive complication, those four image bearing members are referred to as image bearing member 20. Further, charging means, exposing means, developing devices, etc., also are similarly referred to without the suffix which represents color.

The surface of the four image bearing members 20 is uniformly charged to a predetermined necessary potential level by the primary charging means 21. Then, by exposing the surface of the image bearing members 20 by the exposing means 21, an electrostatic latent image is formed on the image bearing member 20. Then, the electrostatic latent image on the image bearing member 20 is developed into a toner image as a visible image by a developing device 23, which uses developer. The image forming sections 200Y, 200M, 200C and 200K, which form the aforementioned four monochromatic toner images, different in color, one for one, are serially aligned in tandem, and carry out the processes for forming four monochromatic toner images, different in color, one for one.

The toner images formed on the image bearing members 20 by the development of the electrostatic latent image on the image bearing members 20 by the developing devices 23 are sequentially transferred in layers (primary transfer) by the primary transferring devices 24, onto the intermediate transfer member 25, which is in the form of an endless belt, for example. Then, the four images, different in color, on the intermediate transfer member 25 are transferred together by the secondary transfer device 26 having a secondary transfer section 7, onto a sheet S of recording medium.

The sheet S is conveyed by the conveying means from one of sheet storage portions 31, 32 and 33 to the secondary transfer device 26. After the secondary transfer, the sheet S on which the unfixed toner images has been transferred is sent to the fixing device 27 of the belt type, which will be described later. In the fixing device 27, the sheet S and the unfixed toner images thereon, are subjected to heat and pressure. Consequently, the unfixed toner images are melted (softened), and become fixed to the sheet S. After the fixation, the sheet S is discharged into a delivery tray 28.

In a case where an image is formed on both surfaces of the sheet S (in two-sided image formation mode), as the sheet S comes out of the fixing device 27 after the formation of an image on one (first) of the two surfaces of the sheet S, the sheet S is turned over by the sheet turning passage 29. Then, it is conveyed to the secondary transfer section 27 for the second time by the two-sided mode passage 30. Then, an image is formed on the second (back) surface of the sheet S.

As described above, the image formation sequence comprising the charging, exposing, developing, transferring, and fixing processes is carried out. Consequently, an image is formed (recorded) on the sheet S. By the way, a monochromatic image forming apparatus has only the black image forming section. Further, this embodiment is not intended to limit the present invention in terms of structure of each of the image forming sections 200Y, 200M, 200C and 200K, and also, in the order in which the image forming sections are aligned. A referential code 160 stands for an automatic document conveying device (ADF, RDF) mounted in the image forming apparatus 100.

<Fixing Device>

Figure 1:
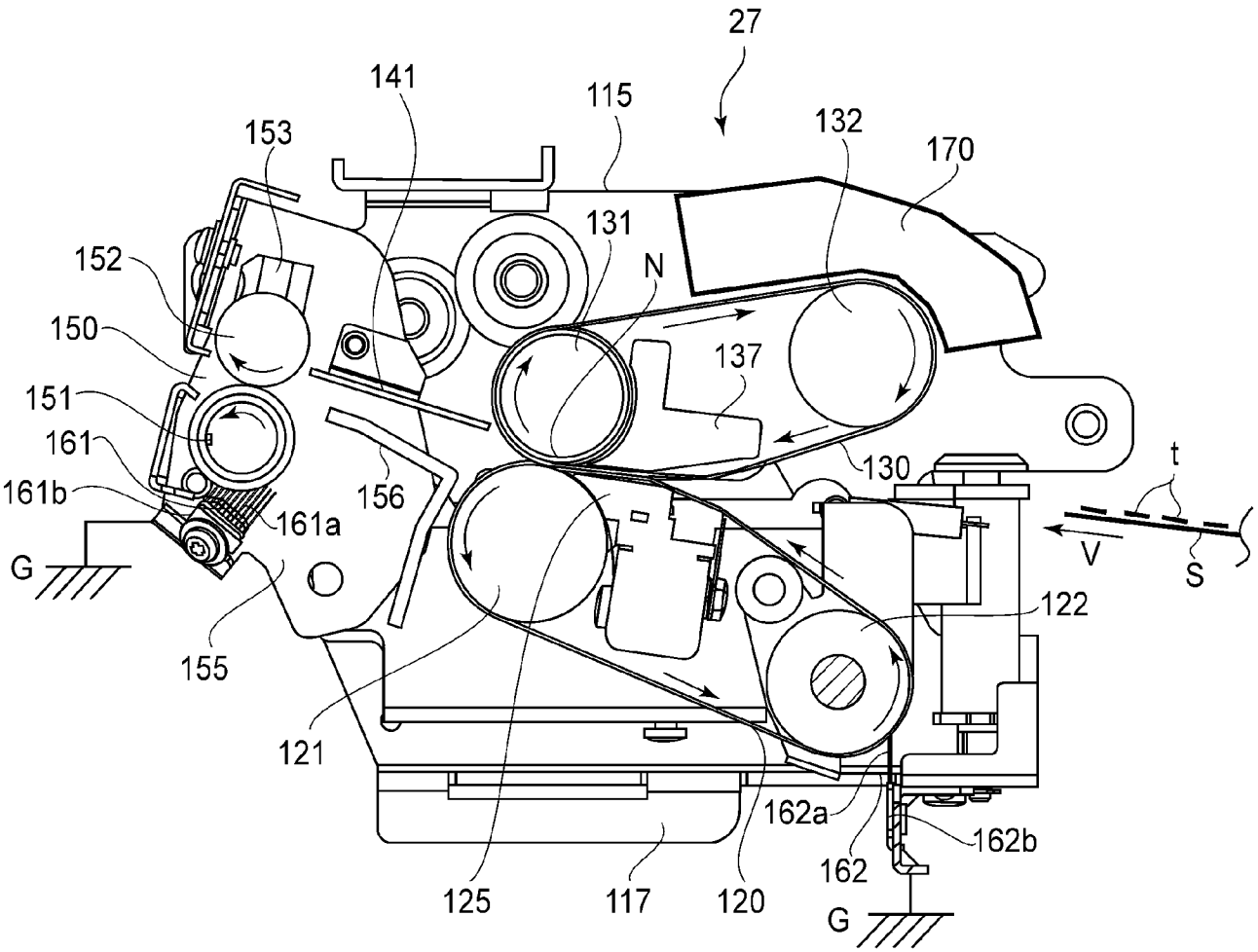
FIG. 1 is a schematic sectional view of the fixing device in the first embodiment of the present invention, which is for describing the device.
Figure 3:
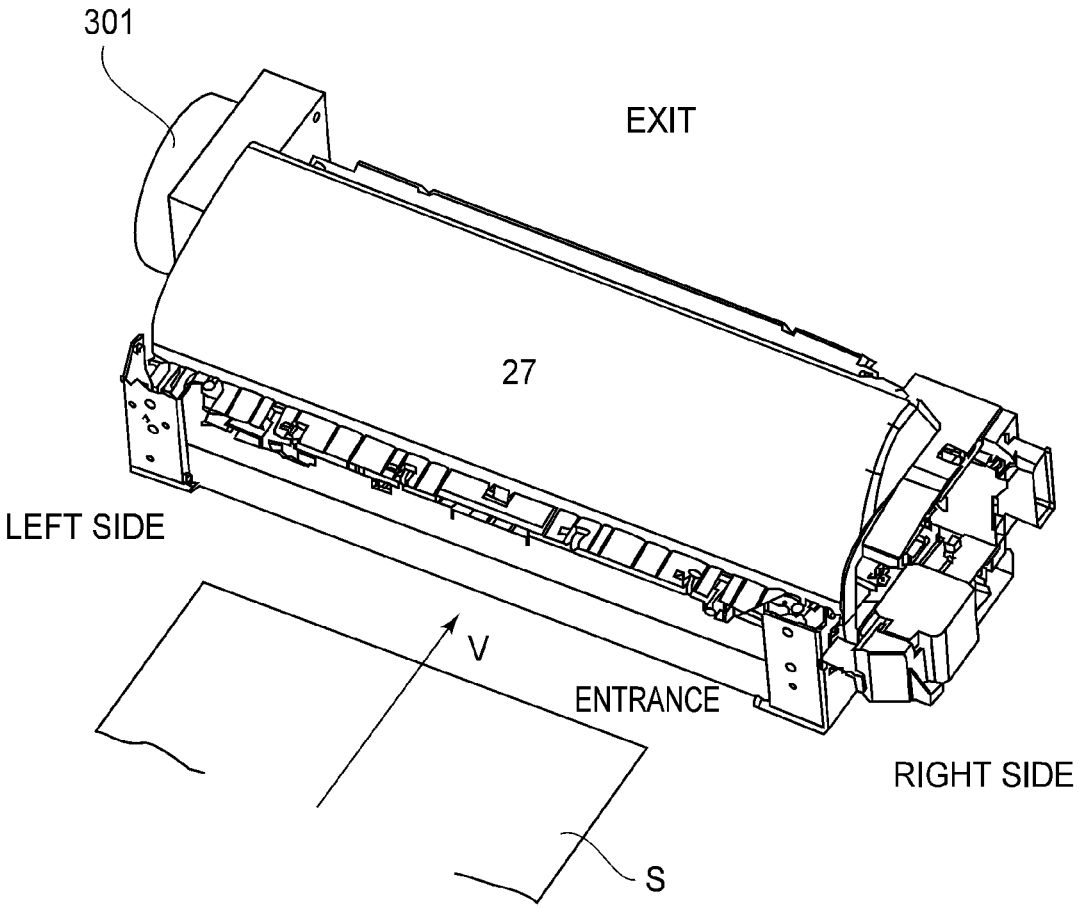
FIG. 3 is a perspective view of the fixing device in the first embodiment.
Figure 4:
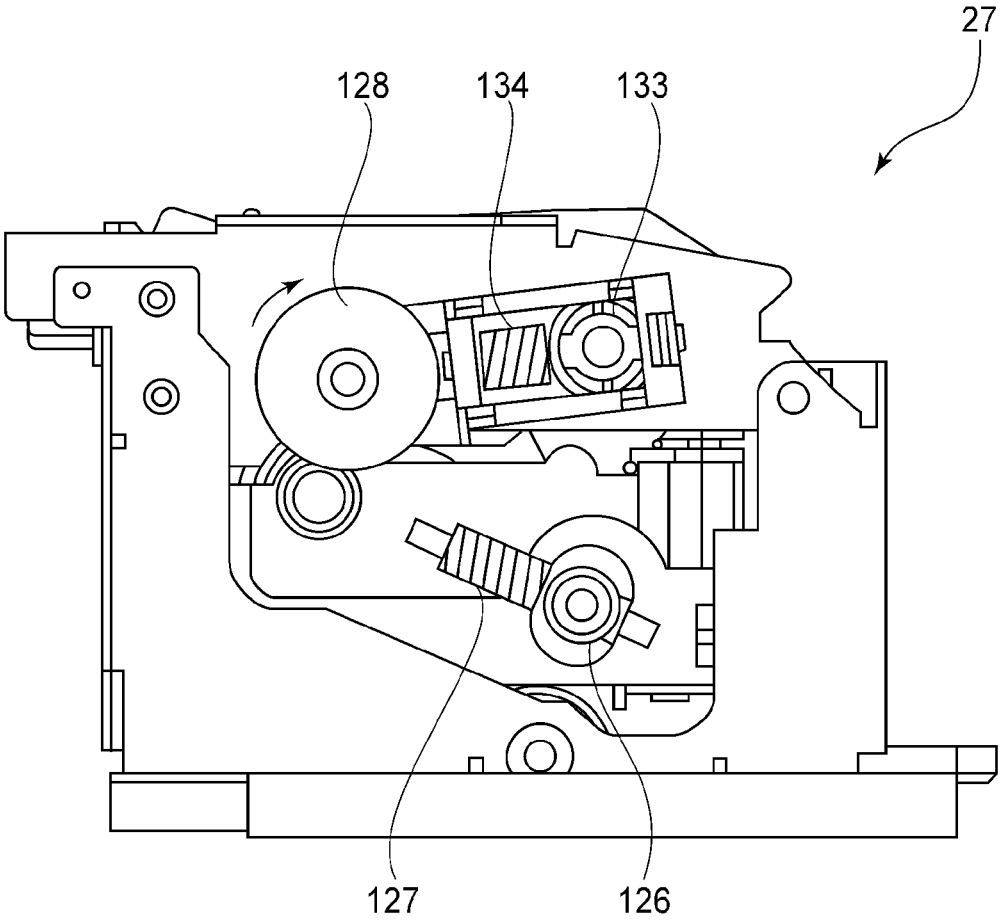
FIG. 4 is a side view of the fixing device in the first embodiment, which is for describing the driving system of the device.

Next, referring to FIGS. 1 and 3-4, the fixing device 27 is described in detail about its structure. FIG. 1 is a cross-sectional view of the fixing device 27. FIG. 3 is an external perspective view of the fixing device 27. FIG. 4 is a drawing for describing the structure of the driving system of the fixing device 27.

Referring to FIG. 3, the "front side" of the fixing device 27 means the sheet entrance side of the fixing device 27, and the "rear side" of the fixing device 27 means the sheet exit side of the fixing device 27. The "left or right side" of the fixing device 27 means the left or right side of the fixing device 27 as seen from the front side. Further, the "upstream or downstream side" of the fixing device 27 means the upstream or downstream side with reference to the direction V in which the sheet S is conveyed through the fixing device 27.

Referring to FIG. 1, the fixing device 27 is made up of a heat belt 130 attached to the fixation frame 115, and a pressure belt 120 attached to a pressure frame 117. It forms a nip N by placing the pressure belt 120 in contact with the heat belt 130 in such a manner that the pressure belt 120 is pressed upon the heat belt 130. The heat belt 130 generates heat by electromagnetic induction. The heat belt 130 and pressure belt 120 are the pair of fixing members which fix the toner image t on the sheet S, in the nip N, while it conveys the sheet S through the nip N, with the sheet S remaining pinched between the two members 130 and 120. The heat belt 130 is the first fixing member which contacts the toner image bearing surface of the sheet S, and the pressure belt 120 is the second fixing member, which contacts the opposite surface of the sheet S from the toner image bearing surface.

The sheet S on which the unfixed toner image t is present is conveyed from the secondary transfer section 7 to the fixing device 27. Then, the sheet S is introduced into the fixing device 27 through the sheet entrance of the fixing device 27, which is on the front side of the fixing device 27. Then, the unfixed toner image t on the sheet S is fixed while the sheet S is conveyed through the nip N, remaining sandwiched between the heat belt 130 and pressure belt 120.

An IH heater (heating device) 170 is a magnetic flux generating means which is made up of an excitation coil, a magnetic core, and a holder which supports the coil and core. It is on the top side of the heat belt 130, being in the adjacencies of the outward surface of the heat belt 130. The excitation coil is made to generate alternating magnetic flux by alternating electric current. The alternating magnetic flux is guided by the magnetic core to the heat belt 130, in which heat can be generated by magnetic induction, and generates eddy current in the heat belt 130. This eddy current generates Joule's heat because of the presence of specific resistance of the heat belt 130. The alternating current which is supplied to the coil is controlled, based on the information regarding the surface temperature of the heat belt 130, which is detected by an unshown temperature detecting means such as a thermistor for detecting the surface layer temperature of the heat belt 130, in such a manner that the surface temperature of the heat belt 130 remains at roughly 180 degrees.

The heat belt 130 is suspended and kept tensioned by multiple rollers, more concretely, a driver roller 131 and a tension roller 132, which are supported by the fixation frame 115, by their lengthwise ends, so that the heat belt 130 is provided with a preset amount (200 N, for example) of tension. The heat belt 130 can be circularly moved in the clockwise direction indicated by an arrow mark.

Figure 9:
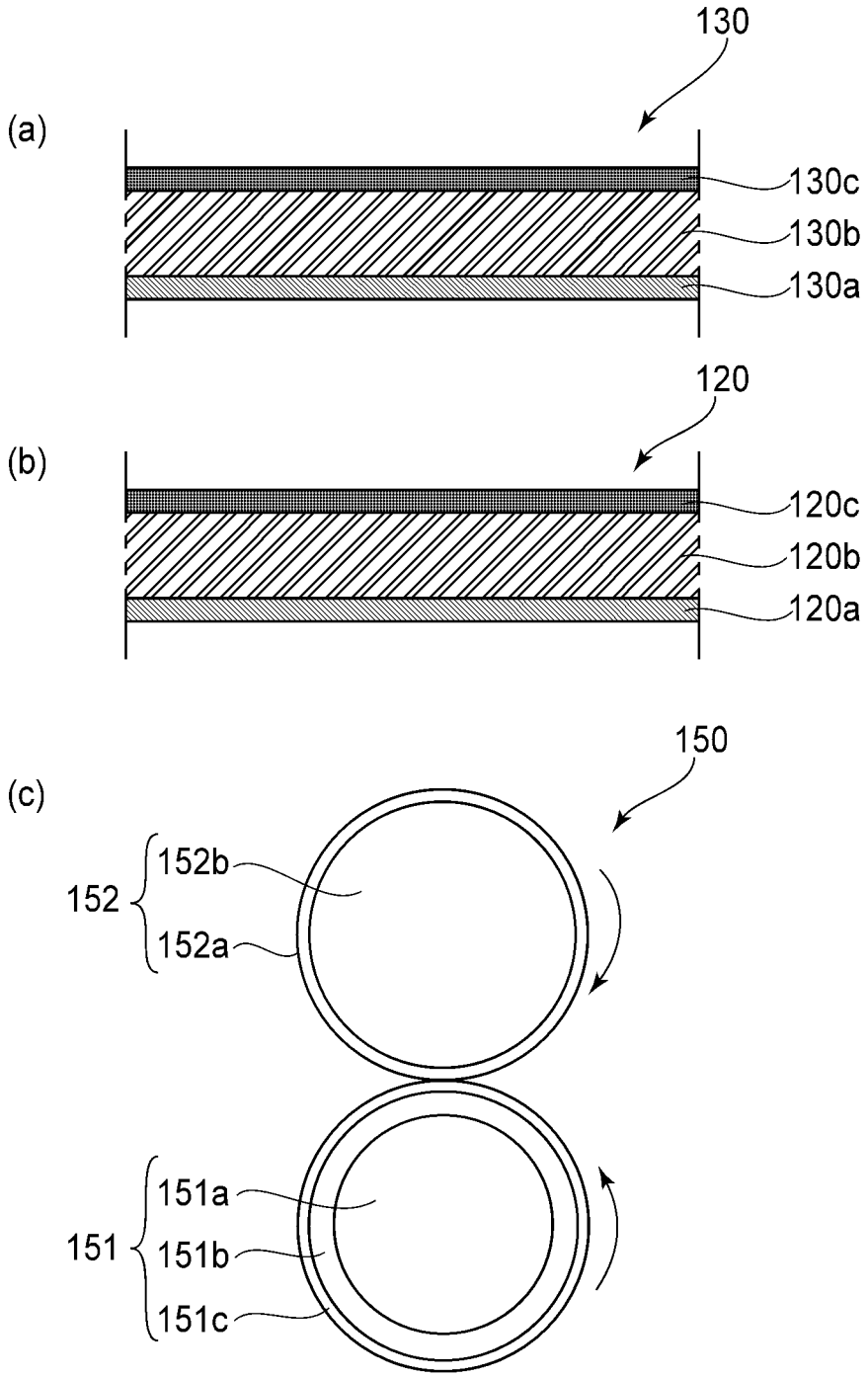
FIG. 9 is a drawing for describing the structure of the structural components of the fixing device which is in accordance with the present invention.

In this embodiment, the heat belt 130 is a laminar member as shown in FIG. 9(*a*) which is a schematic drawing for showing the laminar structure of the heat belt 130. That is, the heat belt 130 in this embodiment is made up of a magnetic metallic layer 130*a*, an electrically nonconductive elastic layer 130*b*, and a surface layer 130*c* (release layer). The metallic layer 130*a* is formed of nickel, stainless steel, or the like, and is 75 mm in thickness, 380 mm in width, and 200 mm in length. The elastic layer 130*b* is a silicon rubber layer coated on the peripheral surface of the metallic layer 130*a* to a thickness of 300 μm. The surface layer 130*c* is a piece of tube formed of electrically nonconductive fluorine resin (PFA resin). It is fitted over the elastic layer 130*b*.

The heat belt choice does not need to be limited to such a heat belt as the heat belt 130 in this embodiment. That is any belt can be employed as the heat belt 130 as long as it is heat resistant and heat can be generated therein by IH heater 170, based on electromagnetic induction. By fitting a piece of PFA tube, as the surface layer, over the peripheral surface of the elastic layer 130*b*, it becomes possible to improve the heat belt 130 in terms of the separation of the thermally melted toner image from the heat belt 130. That is, it becomes possible to reduce the amount by which toner remains adhered to the heat belt 130 after the fixation of the toner image to the sheet S.

The PFA tube, as the material for the surface layer of the heat belt, has to be capable of preventing toner from remaining adhered to the surface of the heat belt 130. Thus, the PFA tube is required to have a high level of release properties. Therefore, it is desired that a substance such as PFA (or PTFA), which has a high level of release properties, is used as the material for the tube.

Before the toner image on the sheet S is thermally melted, it remains electrostatically adhered to the sheet S. Thus, if the surface layer of the heat belt 130 has a high level of electrical conductivity, the electrical charge on the sheet S is disturbed. Therefore, there occurs sometimes image anomalies attributable to the disturbance of the unfixed toner image on the sheet S. Thus, the volume resistivity of the PFA tube, of which the surface layer 130*c* of the heat belt 130 is made, is desired to be no less than $10^{12}$ Ω·cm. Here, regarding the comparison between the release layer 130*c* of the heat belt 130 in this embodiment, and the electrically conductive PFA tube 120*c* of the pressure belt 120, which will be described later, the former is desired to be greater in volume resistivity than the latter.

The heat belt 130 is circularly moved by the rotation of the drive roller 131. In order to ensure that the sheet S is reliably conveyed through the nip N, it is ensured that driving force is transmitted from the driver roller 131 to the heat belt 130.

The drive roller 131 has a function of generating a preset amount of pressure in the nip N by supporting the heat belt 130 by the inward surface of the heat belt 130. The drive roller 131 is disposed on the exit side of the nip N between the heat belt 130 and pressure belt 120. The pressure roller 121 is kept pressed against the drive roller 131. Thus, the elastic layer of the drive roller 131 remains elastically deformed by a preset amount. The driver roller 131 is such a roller that is made up of a solid metallic core which is formed of stainless steel and is 18 mm in external diameter, and an elastic layer molded of heat resistant silicon rubber around the peripheral surface of the metallic core.

The tension roller 132 has a function of controlling the lateral deviation of the heat belt 130 by being tilted in such a manner that one of its lengthwise ends vertically moves, and a function of providing the heat belt 130 with a preset amount of tension. The tension roller 132 is a hollow roller formed of stainless steel. It is 20 mm in external diameter, and roughly 18 mm in internal diameter. It works as a roller for providing the heat belt 130 with tension while supporting the heat belt 130.

As the heat belt 130 is circularly driven, it tends to laterally deviate in the direction parallel to its rotational axis. Thus, the lateral deviation is controlled by tilting the transfer roller 132 with the use of an unshown steering mechanism.

There is a pad stay 137 on the inward side of the loop which the heat belt 130 forms. In terms of the recording medium conveyance direction, the pad stay 137 is on the sheet entrance side of the nip N (upstream side of driver roller 131). The pad stay 137 is formed of stainless steel (SUS). It is kept pressed toward the pressure pad 125 with the application of a preset amount (400 N) of pressure, forming thereby the nip N in coordination with the driver roller 131.

The pressure belt 120 is suspended by the pressure roller 121 and tension roller 122 which are supported by the lengthwise ends of their shaft, in such a manner that it bridges between the pressure roller 121 and tension roller 122, and is provided with a preset amount (200 N, for example) of tension. It can be circularly driven in the counterclockwise direction indicated by an arrow mark.

The pressure belt 120 in this embodiment is a laminar member as shown in FIG. 9(*b*) which is a schematic drawing for showing the laminar structure of the pressure belt 120. That is, it is made up of a metallic layer 120*a*, an electrically nonconductive elastic layer 120*b*, and a surface layer 120*c* (conductive surface layer, release layer). The metallic layer 120*a* is formed of nickel, and is 50 μm in thickness, 380 mm in width, and 200 mm in length. The elastic layer 120*b* is a silicon rubber layer coated on the peripheral surface of the metallic layer 120*a* to a thickness of 300 μm. The surface layer 120*c* is a piece of tube formed of electrically nonconductive fluorine resin, more concretely, PFA resin (GF tube ST (product of Gunze Co., Ltd.) which dispersively contains carbon black). It is fitted over the elastic layer 120*b*. The surface layer of the pressure belt 120 in this embodiment is roughly $10^9$ Ω·cm in volume resistivity.

The pressure belt choice does not need to be limited to such a belt as the pressure belt 120 in this embodiment. That is any belt can be employed as the pressure belt 120 as long as it is heat resistant. However, in terms of volume resistivity, the electrically conductive PFA tube, which is used as the electrically conductive surface layer of the pressure roller 121, is desired to be in a range of $10^7$-$10^{11}$ Ω·cm. In comparison with the electrically conductive release layer 151*c* of the conveyance drive roller 151 of the roller pair 150 which will be described later, the volume resistivity of the release layer 120*c* of the pressure belt 120 is desired to be greater than the release layer 151*c* of the conveyance driver roller 151.

In terms of removal of electric charge from the sheet S, it is desired that the tube 120*c* is lower in resistance. However, if the volume resistivity of the tube 120*c* is no more than $10^7$ Ω·cm, the electrical charge which is necessary to keep the toner adhered to the sheet S leaks. Thus, the force which keeps the toner image adhered to the sheet S reduces. Therefore, it sometimes occurs that an unsatisfactory image, which is attributable to the problem that the toner on the sheet S scatters before fixation, is formed. Further, as the sheet S bridges between the secondary transfer section 7 and nip N while it is being conveyed, the electrical current for transferring the toner image in the secondary transfer section 7 excessively leaks through the sheet. Therefore, it sometimes occurs that an unsatisfactory image, which is attributable to transfer error, is formed.

Further, mixing electrically conductive substance (carbon black and the like) into the material for the PFA tube to provide the PFA tube with electrical conductivity reduces the PFA tube in its ability to release toner. If the surface layer of the heat belt 130 is made electrically conductive to remove electrical charge from the sheet S, the amount by which toner remains adhered to the PFA tube when the toner image is fixed to the sheet S increases. Thus, it sometimes occurs that the residual toner on the PFA tube is redeposited onto the sheet S, causing thereby image anomalies. Thus, from the standpoint of removing electrical charge from the sheet S without affecting image quality, it is preferable to make electrically conductive, the surface layer 120*c* of the pressure belt 120, which contacts the opposite surface of the sheet S from the image bearing surface of the sheet S.

A discharge brush 162 is placed in contact with the surface layer 120*c* of the pressure belt 120 in such an attitude that the angle between the discharge brush 162 and the moving direction of the pressure belt 120 becomes obtuse. The discharge brush 162 is electrically in contact with the ground G through the pressure frame 117. It is made up of a piece of stainless steel plate 162*b*, and a stainless steel brush portion 162*a* fixed to the stainless steel plate 162*b* with the use of electrically conductive tape. Since the discharge brush 162 contacts components (pressure belt 120, conveyance driver roller 152) which needs to be discharged, it desired to be structured so that it does not damage the PFA tube. As substances other than stainless steel which can be used as the material for the discharge brush 162, amorphous, titanium, nickel, or the like is well known.

The pressure roller 121 is a solid roller formed of stainless steel. It is 20 mm in external diameter. It is one of the two rollers by which the pressure belt 120 is suspended. It is disposed on the sheet exit side of the nip N which is between the pressure belt 120 and heat belt 130.

The tension roller 122 has a function of controlling the lateral deviation of the pressure belt 120 by being tilted in such a manner that one of its lengthwise ends vertically moves, and a function of providing the pressure belt 120 with a preset amount of tension. The tension roller 122 is a hollow roller formed of stainless steel. It is 20 mm in external diameter, and roughly 18 mm in internal diameter. It works as a roller for providing the pressure belt 120 with tension.

As the pressure belt 120 is circularly driven, it tends to laterally deviate in the direction parallel to the rotational axis of the tension roller 122. Thus, the lateral deviation is controlled by tilting the tension roller 122 with the use of an unshown steering mechanism.

There is a pressure pad 125 on the inward side of the loop which the pressure belt 120 forms. In terms of the recording medium conveyance direction, the pressure pad 125 is on the sheet entrance side of the nip (upstream side of pressure roller 121). The pressure pad 125 is formed of silicon rubber. It is kept pressed upon the pressure belt 120 with the application of a preset amount (400 N) of pressure, forming thereby the nip N in coordination with the pressure roller 121.

Referring to FIG. 4, both ends of the tension roller 132 are supported by bearings 133, which are under the pressure generated by compression springs 134. Thus, the tension roller 132 provides the heat belt 130 with 200 N (20 kgf) of tension. Both ends of the tension roller 122 are supported by bearings 126, which are under the pressure generated by compression springs 127. Thus, the tension roller 122 provides the pressure belt 120 with 200 N (20 kgf) of tension.

Driving force is externally inputted into a gear 128 by a motor 301 (FIG. 3). The gear 128 is in connection to one of the lengthwise ends of the shaft of the driver roller 131. The driver roller 131 and pressure roller 121 are in connection to each other through an unshown gear train which is on the opposite of the driver roller 131 (pressure roller 121) from the gear 128. Thus, they rotate together.

<Recording Medium Conveyance Structure on the Downstream Side of Fixation Nip>

As described above, the fixing device 27 fixes the unfixed toner image t image which was electrostatically transferred onto the sheet S, to the sheet S by conveying the sheet S, while keeping the sheet S sandwiched between the heat belt 130 and pressure belt 120, through the nip N which the heat belt 130 and pressure belt 120 form. The toner on the sheet S is melted by the heat given by the heat belt 130. As the toner melts, it becomes adhesive, and therefore, it tends to stick the sheet S to the surface of the heat belt 130. In particular, in a case where a toner image t is fixed to a thin sheet of recording medium, which is less rigid (less resilient), it is possible that the sheet S will jam the fixing device 27 by wrapping around the heat belt 130.

Therefore, the fixing device 27 in this embodiment is provided with a separating member 141 which is disposed so that it does not contact the heat belt 130. More specifically, the separating member 141 is disposed in the immediate adjacencies of the heat belt 130, in such a manner that it extends in the direction (direction perpendicular to sheet conveyance direction V, direction parallel to axial line of driver roller 131) perpendicular to the widthwise direction, from the adjacencies of the nip N to the adjacencies of the roller pair 150, across the entirety of the sheet conveyance passage between the nip N and roller pair 150. The separating member 141 bears a function of separating the sheet S from the heat belt 130.

After being separated from the heat belt 130 by the separating member 141, the sheet S is conveyed further while being guided by a conveyance guide 156 and separating member 141, and then, is moved out of the fixing device 27 by being conveyed further by the roller pair 150, that is, the post-fixation conveyance rollers, by being pinched by the roller pair 150. The distance between the nip N and the nip of the roller pair 150 is less than the length of the smallest sheet S usable with the image forming apparatus 100, in terms of the recording medium conveyance direction. Therefore, there occurs a situation in which the sheet S remains sandwiched by both the nip N and the nip of the roller pair 150 while it is conveyed.

The roller pair 150 is a combination of a conveyance driver roller 151 and a conveyance idler roller 152, which is rotatably supported by the conveyance frame 155. In this embodiment, the conveyance idler roller 152 is the first conveyance roller, which contacts the toner image bearing surface of the sheet S after the sheet S comes out of the nip N. The conveyance driver roller 151 is the second conveyance roller which contacts the opposite surface of the sheet S from the toner image bearing surface, after the sheet S comes out of the nip N.

To the conveyance driver roller 151, driving force is transmitted from the same unshown driving force source as the one for the heat belt 130, through a driving force transmitting portion made up of gears, etc. As the conveyance driver roller 151 receives the driving force, it rotates in the direction to convey the sheet S. The lengthwise ends of the conveyance idler roller 152 are under roughly 200 gf of pressure generated by the compression springs 153. Thus, the conveyance idler roller 152 remains pressed upon the conveyance driver roller 151. Thus, the conveyance idler roller 152 is rotated by the rotation of the conveyance driver roller 151. The sheet S is conveyed by the rotating roller pair 150 while remaining pinched by the conveyance driver roller 151 and conveyance idler roller 152.

In order to prevent the problem that after the sheet S is conveyed through the nip N, remaining pinched by the heat belt 130 and pressure belt 120, and comes out of the nip N, it is made to droop by the friction between itself and guide 156, etc., and comes into contact with the heat belt 130 for the second time, the roller pair 150 is disposed in the adjacencies of the sheet exit of the nip N. In this embodiment, the roller pair 150 is disposed 40 mm downstream of the sheet exit of the nip N in terms of the sheet conveyance direction. Further, the roller pair 150 conveys the sheet S at a faster speed than the speed at which the sheet S is conveyed through the nip N. In this embodiment, the sheet conveyance speed of the nip N is set to 300 mm/sec, whereas the sheet conveyance speed of the roller pair 150 is set to 315 mm/sec.

As for the positioning of the roller pair 150, it is possible to properly position the roller pair 150 according to the properties of the toner to be used for image formation. For example, it is desired that the roller pair 150 is placed in an area in which the temperature of the binder resin, that is, the primary ingredient, of the toner, is yet to reach the melting point of the binder resin, or an area where the temperature of the toner and that of the sheet S is remaining higher than 100 degrees, after the sheet S and the toner thereon were heated by the nip N.

In other words, the roller pair 150 is desired to be positioned in an area where the toner temperature is no less than the melting point of the binder resin of the toner while the sheet S moves through the nip of the roller pair 150 after being conveyed out of the nip N, or an area where the temperature of the sheet S is no less than 100 degrees while the sheet S is conveyed through the nip of the roller pair 150 after being conveyed out of the nip N. Thus, it is desired that the roller pair 150 is positioned so that its nip will be no more than 50 mm downstream of the sheet exit of the nip N in terms of the sheet conveyance direction.

After the toner image on the sheet S is melted in the nip N, the toner image is allowed to naturally cool to become fixed to the sheet S. During this process, the toner image remains adhesive. Therefore, it is desired that a substance which is excellent in releasing properties is chosen as the material for the surface layer of the separating member 141 and the material for the surface layer of the roller pair 150. Therefore, the surface layer of the separating member 141 is formed of PFA resin, which is coated on the separating member 141. All that is necessary is for the material for the surfaced layer of the separating member 141 to be excellent in terms of releasing properties. For example, it may be formed by adhering a piece of PFA tape, or PTFE sheet, as the surface layer, to the separating member 141.

Referring to FIG. 9(*c*) which is a schematic drawing, the conveyance idler roller 152 is made up of a metallic core 152*a*, and a surface layer 152*b*. The metallic core 152*a* is formed of aluminum alloy, and is 14 mm in external diameter. The surface layer 152*b* is a piece of PFA tube, and is fitted around the metallic core 152*a*. By covering the peripheral surface of the metallic core 152*a* with electrically nonconductive fluorine resin, as the material for the surface layer 152*b* (release layer), more concretely, a piece of PFA tube, it is possible to reduce the amount by which the toner from the sheet S accumulates on the conveyance idler roller 152.

The PFA tube 152*c* of the conveyance idler roller 152 comes into contact with the toner image while the toner image is remaining melted after being melted in the nip N. Therefore, it is required to have a high level of releasing properties, in order to prevent the toner from remaining adhered to the surface of the tube 152*c*. Thus, it is desired that such a substance as PFA (or PTFA) that excels in releasing properties is used as the material for the surface layer of the conveyance idler roller 152.

Further, if an electrically conductive substance (carbon black, etc.) is mixed into the material for the PFA tube to provide the PFA tube with electrical conductivity, the resultant PFA tube will be lower in toner releasing properties. Therefore, it is desired that an electrically nonconductive substance is used as the material for the PFA tube which is used as the surface layer of the conveyance idler roller 152. The PFA tube which is used as the material for the conveyance idler roller 152 is desired to be no less than $10^{13}$ Ω·cm in volume resistivity. Here, in comparison to the electrically conductive PFA tube 151*c* of the conveyance driver roller 151 which will be described later, the volume resistivity of the PFA tube 152*c* of the conveyance idler roller 152 is desired to be greater than that of the electrically conductive PFA tube 151*c*.

As for the conveyance driver roller 151, it is made up of a metallic core 151*a*, an elastic layer 151*b*, and a surface layer 151*c* (electrically conductive surface layer, releasing layer). The metallic core 151*a* is solid. It is formed of stainless steel, and is 12 mm in external diameter. The elastic layer 151*b* is molded of foamed silicon rubber in a manner to cover the peripheral surface of the metallic core 151*a*. The surface layer 151*c* covers the outward surface of the elastic layer 151*b*, and is a layer of fluorine resin. More concretely, it is a piece of electrically conductive PFA tube (for example, GF tube ST: product of Gunze Co., Ltd.) which dispersively contains carbon black), fitted around the elastic layer 151*b*. The volume resistivity of the conveyance driver roller 151 in this embodiment is roughly $10^6$ Ω·cm.

The choice of the conveyance driver roller is not limited to such a roller as the conveyance driver roller 151 in this embodiment. That is, any roller may be employed as long as it is provided with heat resistance. The volume resistivity of the electrically conductive PFA tube as the material for the surface layer 151*c* is desired to be in a range of $10^5$-$10^8$ Ω·cm.

In this embodiment, the electrical charge of the sheet S is removed in the nip N by the electrically conductive surface layer 120*c*, which is a toner releasing layer of the pressure belt 120. Therefore, it is effective to make the surface layer 151, which is the electrically conductive toner releasing layer of the conveyance driver roller 151, smaller in volume resistivity than the surface layer 120*c* of the pressure belt 120.

Further, the toner image on the sheet S is fixed in the nip N. Therefore, the roller pair 150 has little effect upon the scattering of toner on the sheet S. However, the surface layer 151*c*, which is the electrically conductive toner releasing layer of the conveyance driver roller 151, allows electrical charge leaks from the sheet S. Therefore, the electric current for transferring the toner image in the secondary transfer section 7 excessively flows out through the sheet S when the sheet S is bridging the secondary transfer section 7, nip N, and roller pair nip, at the same time. In this situation, the image forming apparatus 100 sometimes output unsatisfactory images attributable to unsatisfactory transfer.

Thus, the surface layer 151*c*, which is the electrically conductive releasing layer of the conveyance driver roller 151, is desired to be no less than $10^5$ Ω·cm in volume resistivity.

Further, while the sheet S is conveyed through the nip of the roller pair 150, the toner image on the sheet S, which has just been thermally melted in the nip N, is solidifying while remaining adhered to the sheet S. Therefore, it is preferable to make electrically conductive, the surface layer 151*c* of the conveyance driver roller 151, as the second conveyance roller, which comes into contact with the opposite surface of the sheet S from the fixed toner image bearing surface of the sheet S.

The discharge brush 162 is placed in contact with the surface layer 151*c* of the conveyance driver roller 151. It is electrically in connection to the ground G through the conveyance frame 155. It is made up of an actual stainless steel brush 161*a*, and a piece of stainless steel plate 151*b* to which the brush 161*a* is fixed with the use of electrically conductive tape.

<Effects of Discharging>

Figure 5:
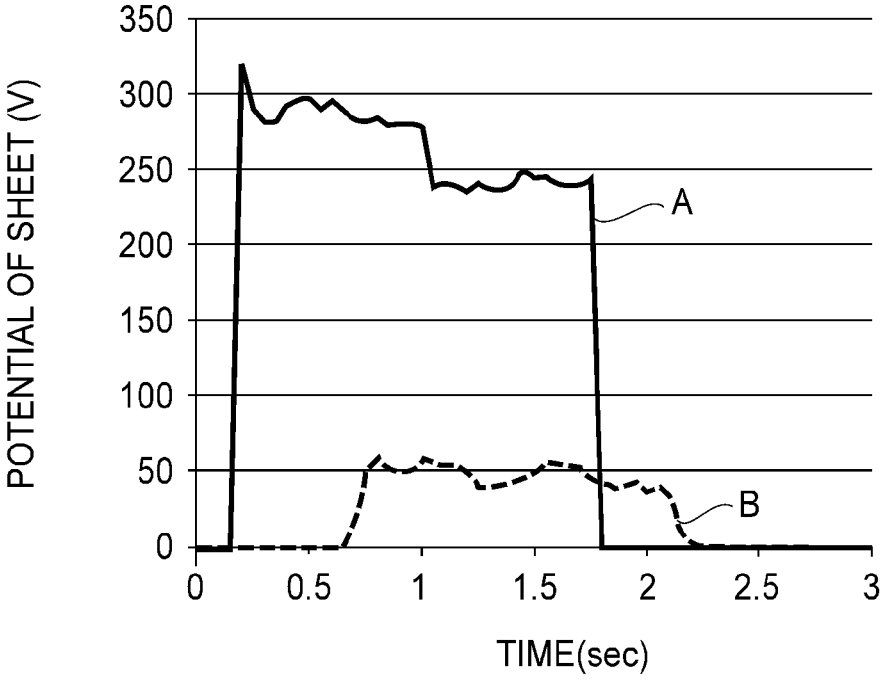
FIG. 5 is a graph for describing the state of electrical charge of recording medium in the conventionally structured fixing device.
Figure 6:
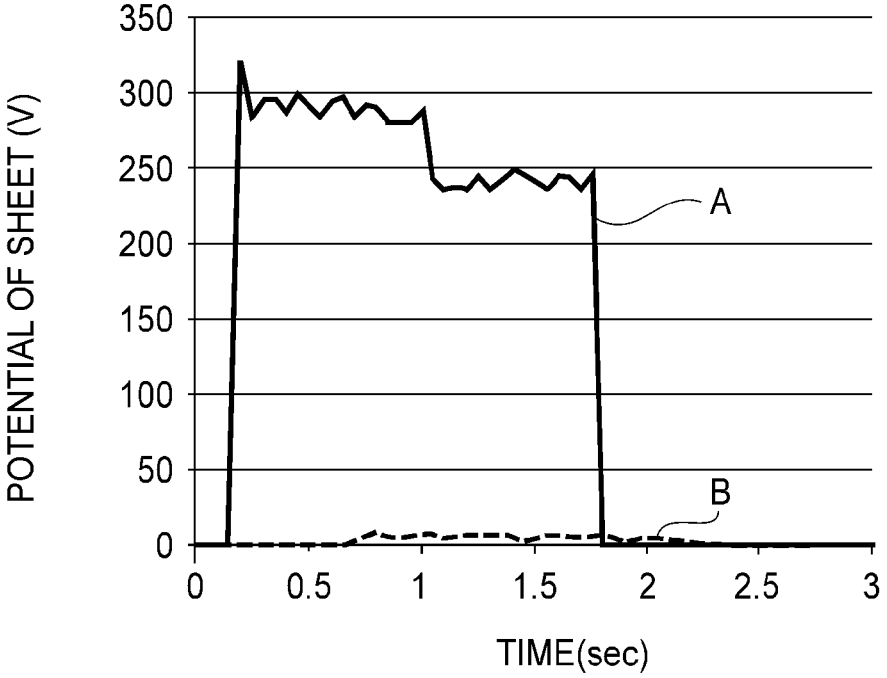
FIG. 6 is a graph for describing the recording medium discharging effect of the fixing device in the first embodiment.

Next, referring to FIGS. 5-8, the above described pressure belt 120 and conveyance driver roller 151 are described about their effect upon the removal of electrical charge from the sheet S (of recording medium). FIG. 5 is a drawing for describing the relationship between the potential level of the sheet S and length of elapsed time, in the conventional fixing device. FIG. 6 is a drawing for describing the electrical charge removing effect of the pressure belt 120 and conveyance driver roller 151 in this embodiment.

In the secondary transfer section 7 of the secondary transfer device 26, in order to transfer the toner image onto the sheet S, electrical voltage is applied to the sheet S. Consequently, the sheet S becomes electrically charged. After the transfer of the toner image onto the sheet S, the toner image is fixed to the sheet S in the nip N of the fixing device 27, and then, the sheet S is conveyed by the nip N and the nip of the roller pair 150.

FIGS. 5 and 6 are drawings for showing the relationship between the potential level of the sheet S and the length of elapsed time. A solid line A represents the potential level of the sheet S measured 5.0 mm downstream from the secondary transfer section 7, and a broken line B represents the potential level of the sheet S measured 10.0 mm downstream from the roller pair 150. The intersection between the horizontal axis and vertical axis is the point in time at which the sheet S entered the secondary transfer section 7. It takes roughly 0.16 seconds for the sheet S to reach a point of measurement after the sheet S enters the secondary transfer section 7. The sheet S is conveyed through the secondary transfer section 7, and then, is introduced into the nip N, in which the toner image is fixed. After the fixation of the toner image to the sheet S, the sheet S is conveyed by the roller pair 150, remaining pinched by the two rollers. Then, it reaches the point of measurement roughly 0.7 seconds after it entered the secondary transfer section 7.

As the conventional conveyance driver roller, a roller, the surface layer of which is a piece of electrically nonconductive PFA tube, was used. Whether the conventional conveyance driver roller 151 or the conveyance driver roller 151 in this embodiment is used, the potential level of the sheet S after the secondary transfer remained roughly the same. However, when the conveyance driver roller 151 in this embodiment was used, the potential level of the sheet S after the conveyance of the sheet S through the nip of the roller pair 150 was substantially lower than when the conventional conveyance driver roller 151 was used. That is, this embodiment made it possible to prevent the occurrence of image anomalies attributable to the electrical charge of the sheet S, and also, to prevent the occurrence of unsatisfactory sheet conveyance which is attributable to the electrostatic adhesion of the charged sheet S to the conveyance guide of the sheet passage.

Figure 7:
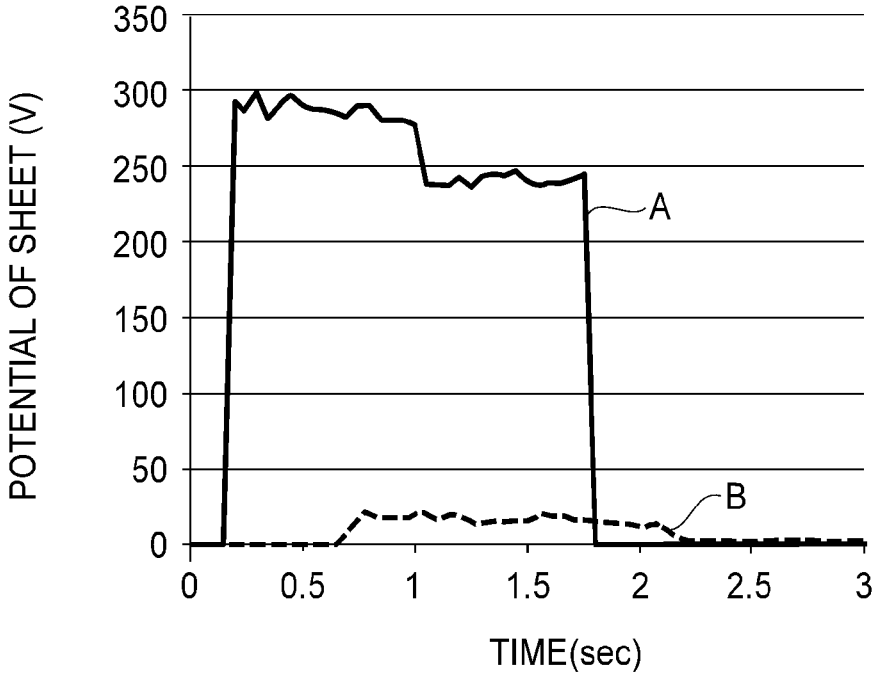
FIG. 7 is a graph for describing the state of recording medium charge in the conventionally structured fixing device.

FIG. 7 is a drawing for describing the effect of this embodiment which makes the surface layer 151*c* of the conveyance driver roller 151 less in volume resistivity than the surface layer 120*c* of the pressure belt 120. It shows the relationship between the potential level of the recording medium and the length of elapsed time. In the case of the comparative conveyance driver roller 151, the volume resistivity of its surface layer 151*c* was set to $10^9$ Ω·cm.

As in FIGS. 5 and 6, a solid line A represents the potential level of the sheet S measured 5.0 mm downstream of the secondary transfer section 7, and a broken line B represents the potential level of the sheet S measured 10.0 mm downstream of the roller pair 150. In the case of the comparative fixing device, the potential level of the sheet S measured on the downstream side of the roller pair 150 was lower than the conventionally structured fixing device. However, it was still higher compared to the fixing device 27 in this embodiment.

Figure 8:
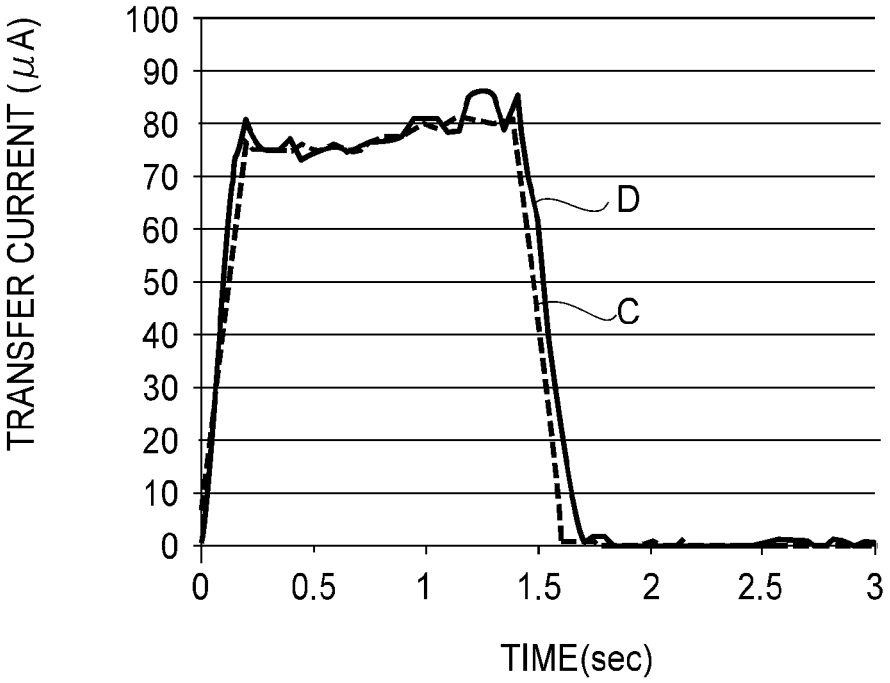
FIG. 8 is a graph for describing the discharging of recording medium in the fixing device in the first embodiment.

FIG. 8 is a drawing for describing the effect of the structural arrangement in this embodiment upon the secondary transfer of the toner image. It shows the relationship between the changes which occurred in the amount of the secondary transfer current after the application of the transfer voltage in the secondary transfer section 7, and the length of elapsed time after the application of the transfer voltage. A solid line C represents the secondary transfer current related to the above described conventional structural arrangement, and a broken line D represents the secondary transfer current related to the structural arrangement in this embodiment. The intersection between the horizontal axis and vertical axis corresponds to the point in time at which the sheet S entered the secondary transfer section 7.

In terms of the amount of the secondary transfer current, the structural arrangement in this embodiment is similar to that of the conventional one. That is, the effect of the method, in this embodiment, for discharging the sheet S is small in terms of the image anomalies attributable to the excessive amount of drain of electric charge from the sheet S.

Incidentally, the potential level of the sheet S was measured with the use of a measuring device (High-speed, High-voltage Electrostatic Voltmeter (Model 341B: product of Trek, Inc.), which was placed in the image forming apparatus 100. The sheets S used for the measurement were coated sheets (OK top coat, which is 128 gms in basis weight, and A3 in size: product of Oji Paper Co., Ltd.). In order to confirm the effects of the charging of the sheet S, which occurs during the secondary transfer, toner images were formed based on a test chart for measurement, which is not described in detail here.

According to the discharging method based on the structural arrangement in this embodiment, it is possible to more satisfactorily discharge the sheet S than that based on the conventional structural arrangement. Further, it is possible to more satisfactorily set the volume resistivity of the pressure belt 120 and that of the conveyance driver roller 151. Therefore, it is possible to prevent the problem that electrical charge is excessively drained from a sheet of recording medium. Therefore, it is possible to prevent the problem that image anomalies are caused because the electrical charge for keeping the toner held to the sheet is excessively drained.

This embodiment was described with reference to a fixing device 27 structured so that the nip N for fixing the toner image on the sheet S is formed by a pair of endless belts. However, the present invention is also applicable to a fixing device structured so that the first and second members which form the nip N are a pair of rollers, or a combination of an endless belt and a roller. Further, the second fixing member may be a pad (nonrotational member), the surface of which is small in coefficient of friction.

Embodiment [2]

The image forming apparatus 100 and fixing device 27 in this embodiment are similar in structure as those in the first embodiment. Therefore, only their difference in structure from those in the first embodiment are described, with reference to FIG. 1.

Used as the pressure belt 120 in this embodiment is an endless belt, the surface layer of which is a piece of an electrically conductive PFA tube (for example, GF tube ST: product of Gunze Co., Ltd.) which dispersively contains carbon black). The volume resistivity of the pressure belt 120 in this embodiment is roughly $10^7$ Ω·cm.

With the surface layer 120*c* of the pressure belt 120, a discharge brush 162 is placed in contact, in such an attitude that its angle relative to the rotational direction of the pressure belt 120 becomes obtuse. The discharge brush 162 is fixed to the pressure frame 117, which is electrically in connection to the ground G through an electrically resistant element which is 1,000 Ω·cm in electrical resistance.

Used as the conveyance driver roller 151 is a roller, the surface layer of which is a piece of an electrically conductive PFA tube (for example, GF tube ST: product of Gunze Co., Ltd.) which dispersively contains carbon black. The volume resistivity of the surface layer 151*c* in this embodiment is roughly $10^7$ Ω·cm. With the surface layer 151*c* of the conveyance driver roller 151, a discharge brush 161 is placed in contact. The discharge brush 161 is fixed to the conveyance frame 155, which is electrically in connection to the ground G through an electrically resistant element which is 10 Ω·cm in electrical resistance.

That is, the value of the electrical resistance between the discharge brush 162 which is in contact with the electrically conductive release layer 120*c* of the pressure belt 120, and the ground G, is greater than the value of the electrical resistance between the discharge brush 161 which is in contact with the electrically conductive release layer 151*c* of the conveyance driver roller 151. According to the structural arrangement in this embodiment, it is possible to obtain the same effects as those obtainable by structural arrangement in the first embodiment.

In this embodiment, the present invention was realized by making the electrically resistant element placed between one of the two discharge members and the ground, different in the amount of resistance from the electrically resistant element placed between the other discharge element and the ground. However, this embodiment is not intended to limit the present invention in scope. That is, the present invention is applicable to any structural arrangement for a fixing device, as long as it makes the electrically resistant element placed between one of the two discharge members and the ground, different in the amount of resistance from the electrically resistant element placed between the other discharge element and the ground. For example, the present invention can be embodied (realized) by making the two discharging members different in electrical resistance in order to make the electrical resistance between one of the discharging members and the ground, different from that between the other discharging member and the ground.

As described above, according to the above described embodiments of the present invention, it is possible to satisfactorily discharge a sheet of recording medium in the adjacencies of the fixation nip, without causing image anomalies, and the like.

Further, the fixing device in the preceding embodiments were a device for fixing an unfixed toner image t to a sheet S of recording medium. However, these embodiments are not intended to limit the present invention in scope. That is, the present invention is also applicable to a device (which is also referred to as fixing device) for applying heat and pressure to a temporarily fixed toner image on a sheet of recording medium, in order to improve the image in gloss.

Further, in the preceding embodiments, the heating device was of the electromagnetic induction type. However, these embodiments are not intended to limit the present invention in scope in terms of heating method. That is, the present invention is also applicable to a fixing device which employs a heating device such a halogen heater, and the like, that is, heating device which use other heat generating method than electromagnetic induction. More concretely, the present invention is also applicable to a fixing device, the driver roller 131 and pressure roller 121 of which internally hold a heating device such as a halogen heater.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-066156 filed on Mar. 27, 2014, which is hereby incorporated by reference herein in its entirety.

What is claimed is:

1. A fixing apparatus comprising:

a fixing device configured to nip and feed a sheet to fix a toner image on a sheet, said fixing device including (i) a first fixing member contactable with a toner image carrying surface of the sheet, and (ii) a second fixing member provided with a first electroconductive surface layer, which has a volume resistivity of $10^7$-$10^{11}$ Ωcm, contactable with a surface of the sheet opposite to the toner image carrying surface;

a feeding device provided downstream of said fixing device with respect to a feeding direction of the sheet and configured to nip and feed the sheet, said feeding device including (i) a first feeding roller contactable with the toner image carrying surface of the sheet, and (ii) a second feeding roller provided with a second electroconductive surface layer, which has a volume resistivity of $10^5$-$10^8$ Ωcm and is lower than that of said first electroconductive surface layer, contactable with the surface of the sheet opposite the toner image carrying surface;

a first electrical discharging member contacted with said first electroconductive surface layer to electrically discharge said second fixing member; and a second electrical discharging member contacted with said second electroconductive surface layer to electrically discharge said second feeding roller.

2. An apparatus according to claim 1, wherein a surface layer of said first fixing member has a volume resistivity which is larger than that of said first electroconductive surface layer.

3. An apparatus according to claim 2, wherein a surface layer of said first fixing member has a volume resistivity of $10^{12}$ Ωcm or more.

4. An apparatus according to claim 2, wherein a surface layer of said first feeding roller has a volume resistivity which is larger than that of said second electroconductive surface layer.

5. An apparatus according to claim 4, wherein a surface layer of said first feeding roller has a volume resistivity not less than $10^{13}$ Ωcm or more.

6. An apparatus according to claim 1, wherein said fixing device and said feeding device are positioned such that said first feeding roller, said second feeding roller, said first fixing member and said second fixing member simultaneously nip the sheet having a minimum length usable with said apparatus.

7. An apparatus according to claim 6, wherein the temperature of toner at the time when the sheet passes between said first and second feeding rollers is not less than a melting temperature of binder resin material of the toner.

8. An apparatus according to claim 1, wherein a resistance between said first electrical discharging member and a ground is larger than that between said second electrical discharging member and the ground.

9. A fixing apparatus comprising:

a fixing device configured to nip and feed a sheet to fix a toner image on the sheet, said fixing device including (i) a first fixing member provided with a first fluorinated resin material layer having a volume resistivity of not less than $10^{12}$ Ωcm or more and contactable with a toner image carrying surface of the sheet, and (ii) a second fixing member provided with a second fluorinated resin material layer having a volume resistivity of $10^7$-$10^{11}$ Ωcm and contactable with a surface of the sheet opposite the toner image carrying surface;

a feeding device provided downstream of said fixing device with respect to a feeding direction of the sheet and configured to nip and feed the sheet, said feeding device including (i) a first feeding roller provided with a third fluorinated resin material layer having a volume resistivity of not less than $10^{13}$ Ωcm or more and contactable with the toner image carrying surface of the sheet, and (ii) a second feeding roller provided with a fourth fluorinated resin material layer having a volume resistivity of $10^5$-$10^8$ Ωcm and contactable with the opposite surface of the sheet;

a first electrical discharging member contacted with said second fluorinated resin material layer to electrically discharge said second fluorinated resin material layer; and a second electrical discharging member contacted with said fourth fluorinated resin material layer to electrically discharge said fourth fluorinated resin material layer.

10. An apparatus according to claim 9, wherein said second fluorinated resin material layer and said fourth fluorinated resin material layer are added with electroconductive filler.

11. An apparatus according to claim 10, wherein said electroconductive filler is made of carbon.

12. An apparatus according to claim 9, wherein said fixing device and said feeding device are positioned such that said first feeding roller, said second feeding roller, said first fixing member and said second fixing member simultaneously nip the sheet having a minimum length usable with said apparatus.

13. An apparatus according to claim 9, wherein a resistance between said first electrical discharging member and a ground is larger than that between said second electrical discharging member and the ground.

* * * * *